US012723213B2

(12) United States Patent
Ketterer et al.

(10) Patent No.: US 12,723,213 B2
(45) Date of Patent: Sep. 1, 2026

(54) LUBRICATING OIL COMPOSITIONS WITH IMPROVED OXIDATIVE PERFORMANCE COMPRISING ALKYLATED DIPHENYLAMINE ANTIOXIDANT AND CARBOXYLATE DETERGENTS

(71) Applicant: CHEVRON ORONITE COMPANY LLC, San Ramon, CA (US)

(72) Inventors: Nicole A. Ketterer, Richmond, CA (US); Claire Chommeloux, Lafayette, CA (US)

(73) Assignee: CHEVRON ORONITE COMPANY LLC, San Ramon, CA (US)

( * ) Notice: Subject to any disclaimer, the term of this patent is extended or adjusted under 35 U.S.C. 154(b) by 759 days.

(21) Appl. No.: 17/908,010

(22) PCT Filed: Mar. 10, 2021

(86) PCT No.: PCT/IB2021/051970

§ 371 (c)(1),
(2) Date: Aug. 30, 2022

(87) PCT Pub. No.: WO2021/181285

PCT Pub. Date: Sep. 16, 2021

(65) Prior Publication Data

US 2025/0188381 A1 Jun. 12, 2025

Related U.S. Application Data

(60) Provisional application No. 62/988,095, filed on Mar. 11, 2020.

(51) Int. Cl.
*C10M 133/12* (2006.01)
*C10M 129/10* (2006.01)
(Continued)

(52) U.S. Cl.
CPC ..... *C10M 133/12* (2013.01); *C10M 129/10* (2013.01); *C10M 129/26* (2013.01);
(Continued)

(58) Field of Classification Search
CPC ..... C10M 133/12; C10M 129/10; C10M 129/26; C10M 133/16; C10M 135/18;
(Continued)

(56) References Cited

U.S. PATENT DOCUMENTS

2006/0025313 A1 2/2006 Boffa
2006/0276677 A1 12/2006 Elnagar et al.
(Continued)

FOREIGN PATENT DOCUMENTS

CN 101687766 3/2010
CN 110114447 8/2019
(Continued)

OTHER PUBLICATIONS

Gatto, Vincent J., et al.; "Redesigning Alkylated Diphenylamine Antioxidants for Modern Lubricants"; (2007), Lubrication Science, vol. 19, pp. 25-40.
(Continued)

*Primary Examiner* — Taiwo Oladapo
(74) *Attorney, Agent, or Firm* — Sheppard, Mullin, Richter & Hampton LLP; Jaime D. Choi

(57) ABSTRACT

Lubricating oil composition is provided. The composition includes several components including a base oil, a primary antioxidant including alkylated diphenylamines having an alkyl group derived from propylene tetramers, and a carboxylate detergent.

18 Claims, 1 Drawing Sheet

(51) Int. Cl.

| | |
|---|---|
| ***C10M 129/26*** | (2006.01) |
| ***C10M 133/16*** | (2006.01) |
| ***C10M 135/18*** | (2006.01) |
| *C10N 10/12* | (2006.01) |
| *C10N 30/04* | (2006.01) |
| *C10N 30/10* | (2006.01) |
| *C10N 40/25* | (2006.01) |

(52) U.S. Cl.
CPC ..... *C10M 133/16* (2013.01); *C10M 135/18* (2013.01); *C10M 2207/023* (2013.01); *C10M 2207/10* (2013.01); *C10M 2215/06* (2013.01); *C10M 2215/086* (2013.01); *C10M 2219/066* (2013.01); *C10N 2010/12* (2013.01); *C10N 2030/04* (2013.01); *C10N 2030/10* (2013.01); *C10N 2040/25* (2013.01)

(58) Field of Classification Search
CPC ..... C10M 2207/023; C10M 2207/10; C10M 2215/06; C10M 2215/086; C10M 2219/066; C10N 2010/12; C10N 2030/04; C10N 2030/10; C10N 2040/25
See application file for complete search history.

(56) References Cited

U.S. PATENT DOCUMENTS

| | | | |
|---|---|---|---|
| 2013/0150275 | A1 | 6/2013 | Rowland |
| 2016/0017252 | A1 | 1/2016 | Rowland |
| 2018/0237722 | A1 | 8/2018 | Burns, III et al. |
| 2019/0390130 | A1 | 12/2019 | Chommeloux et al. |

FOREIGN PATENT DOCUMENTS

| | | | | |
|---|---|---|---|---|
| EP | 0097118 | | 12/1983 | |
| EP | 0976810 | | 2/2000 | |
| EP | 2159275 | | 3/2010 | |
| JP | 11323368 | | 11/1999 | |
| JP | 2006522153 | | 3/2011 | |
| WO | 2008154334 | | 12/2008 | |
| WO | WO-2008154334 | A1 * | 12/2008 | ..... C07C 209/68 |
| WO | 2019244020 | | 12/2019 | |
| WO | 2020194125 | | 10/2020 | |

OTHER PUBLICATIONS

International Search Report, issued on Jun. 4, 2021, during the prosecution of International Application No. PCT/IB2021/051970, 4 pages.

Written Opinion of the International Searching Authority, issued on Jun. 4, 2021, during the prosecution of International Application No. PCT/IB2021/051970, 6 pages.

International Search Report, issued on Jun. 4, 2021, during the prosecution of International Application No. PCT/IB21/051971, 4 pages.

Written Opinion of the International Searching Authority, issued on Jun. 4, 2021, during the prosecution of International Application No. PCT/IB21/051971, 6 pages.

Roby et al., "Development of a Bench Test to Predict Oxidative Viscosity Thickening in the Sequence IIIG Engine Test," SAE Technical Paper Series, Oct. 25, 2004 (Oct. 25, 2004), pp. 1-8, XP093249902, Warrendale, PA 15096-0001 U.S.A. DOI: 10.4271/2004-01-2985.

* cited by examiner

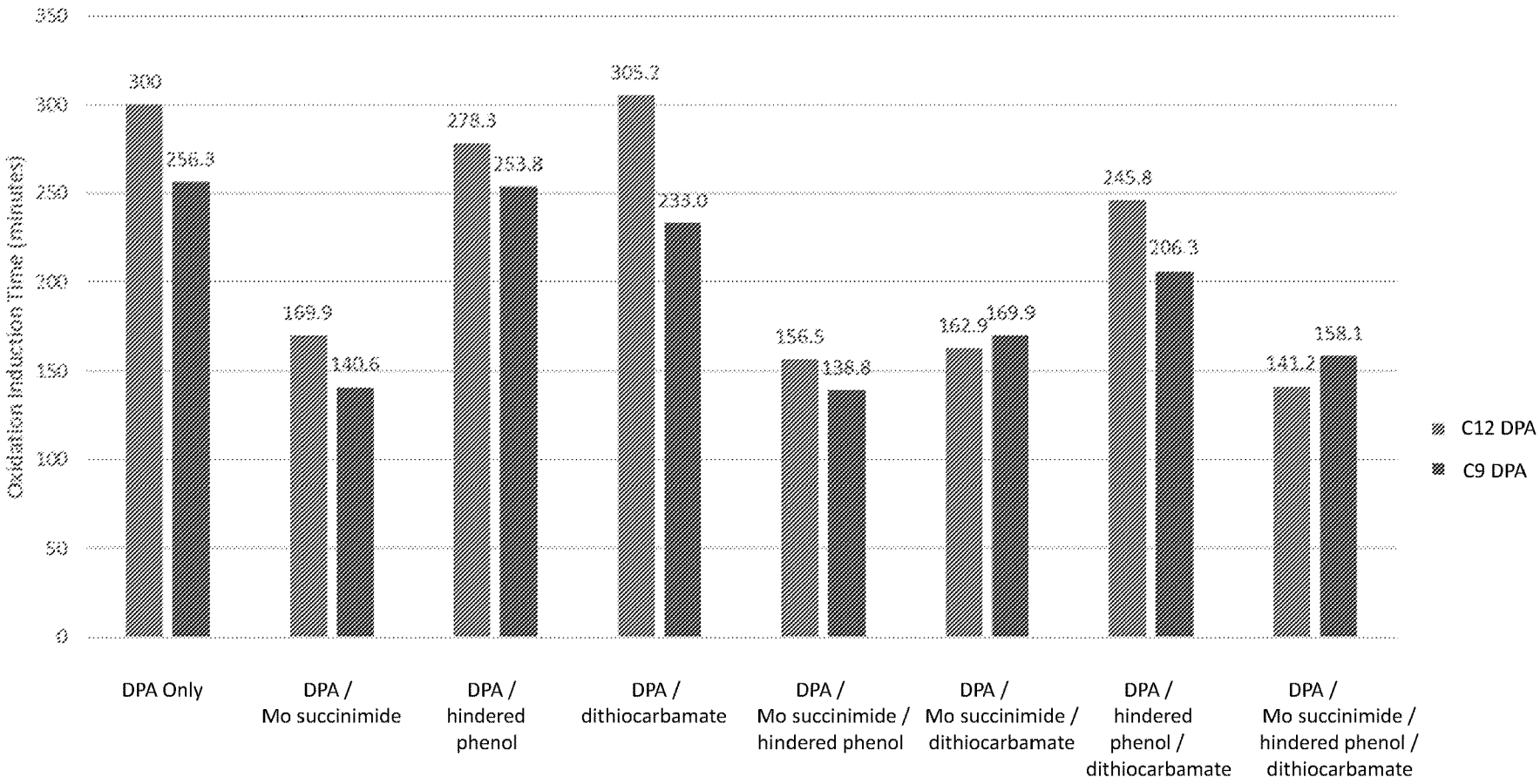
C12 DPA
C9 DPA
Oxidation induction time (minutes)
350
300
250
200
150
100
50
0
300
256.3
169.9
140.6
278.3
253.8
305.2
233.0
156.5
138.8
162.9
169.9
245.8
206.3
141.2
158.1
DPA Only
DPA / Mo succinimide
DPA / hindered phenol
DPA / dithiocarbamate
DPA / Mo succinimide / hindered phenol
DPA / Mo succinimide / dithiocarbamate
DPA / hindered phenol / dithiocarbamate
DPA / Mo succinimide / hindered phenol / dithiocarbamate

LUBRICATING OIL COMPOSITIONS WITH IMPROVED OXIDATIVE PERFORMANCE COMPRISING ALKYLATED DIPHENYLAMINE ANTIOXIDANT AND CARBOXYLATE DETERGENTS

CROSS REFERENCE TO RELATED APPLICATIONS

This application is related to U.S. Provisional Application entitled "IMPROVED OXIDATIVE PERFORMANCE WITH SULFONATE DETERGENTS" 62/988,110 filed on Mar. 11, 2020, the contents of which are herein incorporated by reference.

TECHNICAL FIELD

This disclosure relates to lubricating oil additives that disrupt oxidation and increase the useful life of lubricating oils. More particularly, this disclosure relates to lubricating oil compositions that include alkylated diphenylamine antioxidant and carboxylate detergent.

BACKGROUND

Oxidation is a concern for in-service lubricating oils as it can cause thickening of the oil, sludge, varnish, acid number increase and corrosion. These outcomes are generally detrimental to proper operation of automotive engines and limit useful life of the lubricating oil. With continually evolving engine designs, operating conditions and oil performance expectations, oxidation continues to be an important ongoing technical challenge.

One way to slow down oxidation in engines is to introduce antioxidants to lubricating oils. Additionally, antioxidants can also extend drain intervals, maintain viscosity, reduce deposit, reduce foam formation, protect against corrosion as well as protect lubricating oil against high temperature.

There are many antioxidants that have varying degrees of effectiveness. Commercial lubricants are usually formulated with one or more antioxidants to protect the fluid under a wide range of conditions (e.g., temperature, time, air mixtures, pressure, etc.).

In particular, alkylated diphenylamines are used as antioxidants. Widely-used alkylated diphenylamine antioxidants include nonylated (C9) diphenylamine which can be added into organic fluids such as engine oils, gear oils, hydraulic fluids, compressor oils, turbine oils, and grease.

SUMMARY

This disclosure relates to lubricating oil additives that disrupt oxidation and increase the useful life of lubricating oils. More particularly, this disclosure relates to compositions that include alkylated diphenylamine and carboxylate detergent.

In one aspect, there is provided a lubricating oil composition comprising: a base oil; a primary antioxidant comprising alkylated diphenylamine having an alkyl group derived from propylene tetramer; and a carboxylate detergent.

In a further aspect, there is provided a method of improving oxidation stability of a lubricating oil, the method comprising: supplying to an engine a lubricating oil composition comprising: a major amount of a base oil; and a primary antioxidant comprising alkylated diphenylamine having an alkyl group derived from propylene tetramer; and a carboxylate detergent.

BRIEF DESCRIPTION OF THE DRAWINGS

FIG. 1 illustrates a comparison of oxidative induction times of formulated oil samples as described in the Example.

DETAILED DESCRIPTION

In this specification, the following words and expressions, if and when used, have the meanings ascribed below.

The term "antioxidant" or equivalent term (e.g., "oxidation stabilizer" or "oxidation inhibitor") refers to a composition and its ability to resist deleterious attacks in an oxidizing environment. Antioxidants are often used in organic fluids (e.g., lubricating oil, gear oil, compressor oil, mineral oil, hydraulic fluid, etc.) to improve the oxidation stability of the organic fluid.

The term "alkyl" or related term refers to a saturated hydrocarbon group, that can be linear, branched, cyclic, or a combination of cyclic, linear and/or branched.

The term "olefin" refers to a hydrocarbon that has at least one carbon-carbon double bond that is not part of an aromatic ring or ring system. Olefins may include aliphatic and aromatic, cyclic and acyclic, and/or linear and branched compounds having at least one carbon-carbon double bond that is not part of an aromatic ring or ring system, unless specifically stated otherwise. Olefins having only one, only two, only three, etc., carbon-carbon double bonds can be identified by use of the term "mono," "di," "tri," etc., within the name of the olefin. The olefins can be further identified by the position of the carbon-carbon double bond(s). Depending on the context, the term "olefin" may refer to an "olefin oligomer" or to an "olefin monomer" or both.

An "olefin oligomer" is an oligomer made from oligomerization of "olefin monomers." For example, a "propylene oligomer" is made from the oligomerization of propylene monomers. Examples of propylene oligomers include propylene tetramer and propylene pentamer. A "propylene tetramer" is an olefin oligomer product resulting from the oligomerization of nominally 4 propylene monomers. These terms also can be used generically to describe homo-oligomers, co-oligomers, salts of oligomer, derivatives of oligomers, and the like.

A "minor amount" or related term means less than 50 wt % of a composition, expressed in respect of the stated additive and in respect of the total weight of the composition, reckoned as active ingredient of the additive.

A "major amount" or related term means an amount greater than 50 wt % based on the total weight of the composition.

Antioxidant Composition

The present invention relates to antioxidant compositions that disrupt oxidation and increase the useful life of lubricating oils. More particularly, the present invention describes antioxidant compositions comprising a plurality of lubricant additives. The lubricant additives include at least two antioxidants and at least one detergent working together to provide enhanced oxidative performance. The enhanced performance is a result of a previously unknown synergy arising from the lubricant additive components of the present invention in lubricating oil compositions. Antioxidants and detergents compatible with the present invention will be described herein.

Primary Antioxidant

The antioxidant composition comprises a primary antioxidant and one or more secondary antioxidants. The primary antioxidant of the present invention is an alkylated diphenylamine having one or more relatively long alkyl groups. Conventional alkylated diphenylamine antioxidants typically utilize relatively short alkyl groups. These include, for example, nonylated diphenylamine ("propylene trimer") which nominally has 9 carbons and can be formed from the oligomerization of propylene.

The alkylated diphenylamines of the present invention have been alkylated by propylene tetramers (having nominally 12 carbons) or by a mixture comprising propylene tetramers, wherein the propylene tetramer is the predominant olefin oligomer alkylating agent. Propylene tetramers can be obtained by the oligomerization of 4 propylene monomers. There are several potential advantages of propylene tetramer over propylene trimer including, but not limited to, increased oil solubility, cheaper cost, and superior stability against oxidation.

The alkylated diphenylamine of the present invention may be present at about 0.4 wt % to about 20 wt % of the lubricating oil composition, such as from about 0.5 wt % to about 15 wt %, 0.1 wt % to about 10 wt %, 0.5 wt % to about 8 wt %, or 1 wt % to about 5 wt %.

Propylene Oligomers

The propylene oligomers (i.e., propylene tetramers) of the present invention can be prepared by any compatible method known in the art. By way of an example, a process for preparing the propylene oligomers employs a liquid phosphoric acid oligomerization catalyst. Descriptions of liquid phosphoric acid-catalyzed propylene oligomerization process can be found in U.S. Pat. Nos. 2,592,428; 2,814,655; and 3,887,634, the relevant portions of which are hereby incorporated by reference.

An unrefined product of oligomerization process typically includes a mixture of branched olefins having a distribution in number of carbons. In a commercial setting, olefin oligomers are subject to extreme conditions during the oligomerization process which results in cracking, recombination, isomerization and the like. Refined or processed oligomerization products typically have higher concentration of the desired product. Thus, the term "propylene tetramer" may not necessarily refer to a pure propylene tetramer product but a mixture of olefins or olefin oligomer products. Accordingly, the product of alkylation involving diphenylamine and propylene tetramer can have a distribution in number of carbons within the alkylated alkyl groups.

Propylene tetramers can be obtained from the oligomerization of 4 propylene monomers. The propylene tetramer is a cost effective olefin to manufacture. As a product of oligomerization, it features a highly branched chain of 10 to 15 carbons with high degree of methyl branching that imparts exceptional oil solubility and compatibility with other oil soluble lubricant additive components. In some embodiments, the average carbon number can range from about 10 to about 15.

The product of oligomerization can vary in degree of branching. For example, the propylene tetramer can exhibit a total branching (i.e., sum of olefinic and aliphatic branching) ranging from 1 to 15. In some embodiments, the average total branching can range from about 1 to about 15.

The propylene tetramers of the present invention generally comprise at least 50 wt % of $C_{10}$ to $C_{15}$ carbon atoms. In an embodiment, the propylene tetramers contain a distribution of carbon atoms which comprise at least 60 wt % of $C_{10}$ to $C_{15}$ carbon atoms. In an embodiment, the propylene tetramers contain a distribution of carbon atoms which comprise at least 70 wt % of $C_{10}$ to $C_{15}$ carbon atoms. In an embodiment, the propylene oligomers contain a distribution of carbon atoms which comprise at least 80 wt % of $C_{10}$ to $C_{15}$ carbon atoms. In an embodiment, the propylene oligomers contain a distribution of carbon atoms which comprise at least 90 wt % of $C_{10}$ to $C_{15}$ carbon atoms.

As will be apparent to a person of ordinary skill in the art, the propylene oligomers employed herein may also contain a minor amount lower molecular weight propylene oligomer(s) such as propylene trimer, as well as higher molecular weight propylene oligomer(s) such as propylene pentamer. For example, the propylene tetramer of the present invention may be a mixture of olefinic hydrocarbons containing 0-1 wt % $C_9H_{18}$, 0-5 wt % $C_{10}H_{20}$, 0-10 wt % $C_{11}H_{22}$, 50-90 wt % $C_{12}H_{24}$, 10-20 wt % $C_{13}H_{26}$, 5-15 wt % $C_{14}H_{28}$, and/or 1-10 wt % $C_{15}H_{30}$.

Alkylation

The alkylated diphenylamine of the present invention can be obtained by any alkylation process compatible with the present invention. For example, U.S. Pat. No. 6,355,839, hereby incorporated by reference, describes the preparation of alkylated diphenylamine wherein the diphenylamine is alkylated with polyisobutylene.

Any suitable catalyst may be used. For example, the alkylation of diphenylamine may proceed in the presence of a clay catalyst. Temperature of this reaction can range from 140° C. to 200° C., more typically between 150° C. to 190° C. In some embodiments, the temperature of the reaction ranges between 160° C. to 180° C. The reaction can be carried out at a single temperature, or sequentially, at different temperatures. The propylene oligomer can be charged at a charge mole ratio (CMR) between 2:1 to 8:1 in relation to the diphenylamine charge. In some embodiments, the CMR is between 3:1 to 7:1 or between 4:1 and 6:1. The reaction product can be filtered to remove the catalyst and then distilled to remove unreacted olefin oligomers and diphenylamines. The use of clay as catalyst is disclosed in U.S. Pat. No. 3,452,056, which is hereby incorporated by reference.

As would be expected to a person of ordinary skill in the art, the reaction conditions may vary significantly depending on the catalyst used. For example, reactions involving homogeneous acid catalysts may only require temperatures ranging between 75° C. to 100° C.

Depending on the reaction conditions, the alkylated diphenylamine product can have various relative amounts of mono-alkylated, di-alkylated, and/or tri-alkylated diphenylamine products. It should be apparent that for a given di- or tri-alkylated diphenylamine molecule, the two or more alkylated alkyl groups may be identical or different in accordance with this disclosure.

Secondary Antioxidants

The present invention employs one or more secondary antioxidants in combination with the primary antioxidant. The secondary antioxidant may be present at about 0.01 wt % to about 20 wt % of the lubricating oil composition, such as from about 0.05 wt % to about 15 wt %, 0.1 wt % to about 10 wt %, 0.5 wt % to about 8 wt %, or 1 wt % to about 5 wt %.

A number of secondary antioxidants are compatible with the present invention. Examples of secondary antioxidants include molybdenum succinimides, dithiocarbamates and hindered phenols. These oil-soluble components are generally known.

For example, the mono and polysuccinimides that can be used to prepare the molybdenum complexes described herein are disclosed in numerous references and are well known in the art. Certain fundamental types of succinimides and the related materials encompassed by the term of art "succinimide" are taught in U.S. Pat. Nos. 3,219,666; 3,172,892; and 3,272,746, the disclosures of which are hereby incorporated by reference. The term "succinimide" is understood in the art to include many of the amide, imide, and amidine species which may also be formed. The predominant product however is a succinimide and this term has been generally accepted as meaning the product of a reaction of an alkenyl substituted succinic acid or anhydride with a nitrogen-containing compound.

Preferred succinimides, because of their commercial availability, are those succinimides prepared from a hydrocarbyl succinic anhydride, wherein the hydrocarbyl group contains from about 24 to about 350 carbon atoms, and an ethylene amine, said ethylene amines being especially characterized by ethylene diamine, diethylene triamine, triethylene tetramine, and tetraethylene pentamine. Particularly preferred are those succinimides prepared from polyisobutenyl succinic anhydride of 70 to 128 carbon atoms and tetraethylene pentamine or triethylene tetramine or mixtures thereof.

Also included within the term "succinimide" are the cooligomers of a hydrocarbyl succinic acid or anhydride and a poly secondary amine containing at least one tertiary amino nitrogen in addition to two or more secondary amino groups. Ordinarily this composition has between 1,500 and 50,000 average molecular weight. A typical compound would be that prepared by reacting polyisobutenyl succinic anhydride and ethylene dipiperazine.

Succinimides having an average molecular weight of 1000 or 1300 or 2300 and mixtures thereof are most preferred. Such succinimides can be post treated with boron or ethylene carbonate as known in the art.

Suitable dithiocarbamates include, but are not limited to, dithiocarbamates wherein the metal is zinc, copper or molybdenum, ashless thiocarbamates or dithiocarbamates (i.e., essentially metal free) such as methylenebis(dialkyldithiocarbamate), ethylenebis(dialkyldithiocarbamate), and isobutyl disulfide-2,2'-bis(dialkyldithiocarbamate) where the alkyl groups of the dialkyldithiocarbamate can preferably have from 1 to 6 carbon atoms. Examples of preferred ashless dithiocarbamates are methylenebis(dibutyldithiocarbamate), ethylenebis(dibutylthiocarbamate) and isobutyl disulfide-2,2'-bis(dibutyldithiocarbamate).

The secondary antioxidant employed in the lubricating oil of the present invention may be a sterically hindered phenol. The hindered phenol antioxidant often contains a secondary butyl and/or a tertiary butyl group as a sterically hindering group. The phenol group is often further substituted with a hydrocarbyl group and/or a bridging group linking to a second aromatic group. Suitable hindered phenols include, but are not limited to, 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol.

Detergents

The antioxidant composition of the present invention includes one or more detergents. Detergents may be present at about 0.01 wt % to about 10 wt % of the lubricating oil composition, such as from about 0.05 wt % to about 8 wt %, 0.1 wt % to about 5 wt %, 0.5 wt % to about 4 wt %, or 1 wt % to about 3 wt %.

Detergents are normally salts (e.g., overbased salts) and are single phase, homogeneous Newtonian systems characterized by a metal content in excess of that which would be present according to the stoichiometry of the metal and the particular acidic organic compound reacted with the metal.

The detergents of the present invention include carboxylate detergents such as aromatic carboxylates (e.g., salicylates, naphthenates), aliphatic carboxylates (e.g. stearates), and the like. In particular, salicylates can be prepared by reacting an aromatic carboxylic acid with an appropriate metal compound such as an oxide or hydroxide.

The detergents may be overbased. Overbased detergents may range in degree of overbasing (as measured by ASTM D2896). Compatible carboxylates include, for example, low overbased (TBN from 15 to 30), medium overbased (TBN from 31 to 170), high overbased (TBN from 171 to 400) and high overbased (TBN>400) carboxylate detergents. One or more overbased carboxylate detergents (e.g., low overbased and medium overbased) may be used. The carboxylate detergent may be present in about 0.05 wt % to 5 wt % of the lubricating oil composition.

Metals of carboxylates can also include alkali or alkaline earth metals, e.g., barium sodium potassium, lithium, calcium, and magnesium. The most commonly used metals are calcium and magnesium, which both may be present in detergents used in lubricants, and mixtures of calcium and/or magnesium with sodium.

In some embodiments, additional detergents may be used. The additional detergents include phenates, salicylates, phenolates, phosphonates, thiophosphonates, ionic surfactants, and the like. In some embodiments, additional detergents include hybrid and/or complex detergents.

Lubricating Oil Compositions

The antioxidant compositions of present disclosure may be used in lubricating oil to impart oxidation stability to the lubricating oil. The primary antioxidant, secondary antioxidant, and one or more detergents may be present in any ratio provided that their concentrations fall within the guidelines provided herein.

In general, the antioxidant compositions are oil soluble meaning that they are, for instance, soluble or stably dispersible in oil to an extent sufficient to exert their intended effect in the environment in which the oil is employed. Moreover, the additional incorporation of other additives may also permit incorporation of higher levels of a particular additive, if desired. The term oil-soluble does not necessarily indicate that the compounds or additives are soluble, dissolvable, miscible, or capable of being suspended in the oil in all proportions. If other antioxidants are present in the lubricating oil composition, a lesser amount of the antioxidant of the present invention may be used.

Oils used as the base oil will be selected or blended depending on the desired end use and the additives in the finished oil to give the desired grade of engine oil, e.g. a lubricating oil composition having an Society of Automotive Engineers (SAE) Viscosity Grade of 0W, 0W-8, 0W-16, 0W-20, 0W-30, 0W-40, 0W-50, 0W-60, 5W, 5W-20, 5W-30, 5W-40, 5W-50, 5W-60, 10W, 10W-20, 10W-30, 10W-40, 10W-50, 15W, 15W-20, 15W-30, or 15W-40. Straight grade based oils such as SAE 30, 40, 50, and 60 may also be used.

The oil of lubricating viscosity (sometimes referred to as "base stock" or "base oil") is the primary liquid constituent of a lubricant, into which additives and possibly other oils are blended, for example to produce a final lubricant (or lubricant composition). A base oil, which is useful for making concentrates as well as for making lubricating oil compositions therefrom, may be selected from natural (vegetable, animal or mineral) and synthetic lubricating oils and mixtures thereof.

Definitions for the base stocks and base oils in this disclosure are the same as those found in American Petroleum Institute (API) Publication 1509 Annex E ("API Base Oil Interchangeability Guidelines for Passenger Car Motor Oils and Diesel Engine Oils," December 2016). Group I base stocks contain less than 90% saturates and/or greater than 0.03% sulfur and have a viscosity index greater than or equal to 80 and less than 120 using the test methods specified in Table E-1. Group II base stocks contain greater than or equal to 90% saturates and less than or equal to 0.03% sulfur and have a viscosity index greater than or equal to 80 and less than 120 using the test methods specified in Table E-1. Group III base stocks contain greater than or equal to 90% saturates and less than or equal to 0.03% sulfur and have a viscosity index greater than or equal to 120 using the test methods specified in Table E-1. Group IV base stocks are polyalphaolefins (PAO). Group V base stocks include all other base stocks not included in Group I, II, III, or IV.

Natural oils include animal oils, vegetable oils (e.g., castor oil and lard oil), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Synthetic oils include hydrocarbon oil. Hydrocarbon oils include oils such as polymerized and interpolymerized olefins (e.g., polybutylenes, polypropylenes, propylene isobutylene copolymers, ethylene-olefin copolymers, and ethylene-alphaolefin copolymers). Polyalphaolefin (PAO) oil base stocks are commonly used synthetic hydrocarbon oil. By way of example, PAOs derived from $C_8$ to $C_{14}$ olefins, e.g., $C_8$, $C_{10}$, $C_{12}$, $C_{14}$ olefins or mixtures thereof, may be utilized.

Other useful fluids for use as base oils include non-conventional or unconventional base stocks that have been processed, preferably catalytically, or synthesized to provide high performance characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

Base oils for use in the lubricating oil compositions of present disclosure are any of the variety of oils corresponding to API Group I, Group II, Group III, Group IV, and Group V oils, and mixtures thereof, preferably API Group II, Group III, Group IV, and Group V oils, and mixtures thereof, more preferably the Group III to Group V base oils due to their exceptional volatility, stability, viscometric and cleanliness features.

Typically, the base oil will have a kinematic viscosity at 100° C. (ASTM D445) in a range of 2.5 to 20 $mm^2/s$ (e.g., 3 to 12 $mm^2/s$, 4 to 10 $mm^2/s$, or 4.5 to 8 $mm^2/s$).

The present lubricating oil compositions may also contain conventional lubricant additives for imparting auxiliary functions to give a finished lubricating oil composition in which these additives are dispersed or dissolved. For example, the lubricating oil compositions can be blended with antioxidants, ashless dispersants, anti-wear agents, detergents such as metal detergents, rust inhibitors, dehazing agents, demulsifying agents, friction modifiers, metal deactivating agents, pour point depressants, viscosity modifiers, antifoaming agents, co-solvents, package compatibilizers, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Each of the foregoing additives, when used, is used at a functionally effective amount to impart the desired properties to the lubricant. Thus, for example, if an additive is an ashless dispersant, a functionally effective amount of this ashless dispersant would be an amount sufficient to impart the desired dispersancy characteristics to the lubricant. Generally, the concentration of each of these additives, when used, may range, unless otherwise specified, from about 0.001 to about 20 wt %, such as about 0.01 to about 10 wt %.

The following illustrative examples are intended to be non-limiting.

EXAMPLES

As shown in FIG. 1, oxidation induction times of fully formulated engine oils were tested. The fully formulated engine oils include one or more antioxidants and a salicylate detergent as well as well as common lubricant additives such as dispersant, and corrosion inhibitor.

The first engine oil samples ("DPA Only") includes a salicylate detergent and an alkylated diphenylamine. The alkylated diphenylamine is a nonylated diphenylamine or a diphenylamine alkylated with a propylene tetramer. Gas chromatography analysis of the diphenylamine alkylated with propylene tetramer is summarized in Table 1 below. The analysis shows that roughly half of the sample is mono alkylated diphenylamine. Roughly another half of the sample is di alkylated diphenylamine. There is a very small amount of diphenylamine with C3-C8 alkyl group.

TABLE 1

| DPA | Dimer | C3-C8 DPA | Total Mono DPA | Total Di DPA |
|---|---|---|---|---|
| 0.0% | 0.0% | 0.6% | 50.8% | 48.6% |

Test engine oil samples include one or more secondary antioxidants (i.e., molybdenum succinimide, hindered phenol, dithiocarbamate). In a mixed engine oil sample with multiple antioxidants, each antioxidant is present in equal treat levels/weight percent.

Other engine oil samples featuring two antioxidants include an alkylated diphenylamine with molybdenum succinimide ("DPA/Mo succinimide"), hindered phenol ("DPA/hindered phenol") or dithiocarbamate ("DPA/dithiocarbamate"). Test engine oil samples featuring three antioxidants include an alkylated diphenylamine with molybdenum succinimide and hindered phenol ("DPA/Mo succinimide/hindered phenol"), molybdenum succinimide and dithiocarbamate ("DPA/Mo succinimide/dithiocarbamate"), or hindered phenol and dithiocarbamate ("DPA/hindered phenol/dithiocarbamate"). Test engine oil samples feature four antioxidants include an alkylated diphenylamine with molybdenum succinimide, hindered phenol, and dithiocarbamate ("DPA/Mo succinimide/hindered phenol/dithiocarbamate").

For each test sample, salicylate detergent is present in 65.2 mM while the total concentration of the antioxidant(s) is 1.5 wt %.

The data shows consistently higher oxidation induction times in samples with diphenylamine alkylated with propylene tetramers as compared to samples with nonylated diphenylamine.

Oxidation induction times were evaluated using Pressurized Differential Scanning calorimetry (PDSC) according to ASTM D 6186 test protocol. Greater oxidation induction times indicated greater oxidation stability.

The invention claimed is:

1. A lubricating oil composition comprising:

a base oil;

a primary antioxidant comprising an alkylated diphenylamine having an alkyl group derived from a propylene oligomer wherein the propylene oligomer comprises about 50-90 wt % $C_{12}H_{24}$ and about 1-10 wt % $C_{15}H_{30}$;

about 0.5 wt % to about 4 wt % of a carboxylate detergent; and about 0.5 wt % to about 8 wt % of a secondary antioxidant comprising a dithiocarbamate, a hindered phenol, or a molybdenum succinimide;

wherein at least 90% of the alkyl group of the alkylated diphenylamine have a carbon number between 10 and 15.

2. The lubricating oil composition of claim 1, wherein the carboxylate detergent is an aromatic carboxylate or an aliphatic carboxylate.

3. The lubricating oil composition of claim 1, wherein the carboxylate detergent is a salicylate, a naphthenate, or a stearate.

4. The lubricating oil composition of claim 1, wherein the primary antioxidant is present in 0.4 wt % to 20 wt % of the lubricating oil composition.

5. The lubricating oil composition of claim 1, wherein the carboxylate detergent is low overbased, medium overbased, high overbased or high high overbased.

6. The lubricating oil composition of claim 1, further comprising:

an antioxidant, an ashless dispersant, an anti-wear agent, a detergent, a rust inhibitor, a dehazing agent, a demulsifying agent, a friction modifier, a metal deactivating agent, a pour point depressant, a viscosity modifier, an antifoaming agent, a co-solvent, a package compatibilizer, a corrosion-inhibitor, a dye, or an extreme pressure agent.

7. A method of lubricating an engine, the method comprising:

supplying to the engine a lubricating oil composition comprising:

a major amount of a base oil; and a primary antioxidant comprising an alkylated diphenylamine having an alkyl group derived from a propylene oligomer wherein the propylene oligomer comprises about 50-90 wt % $C_{12}H_{24}$ and about 1-10 wt % $C_{15}H_{30}$;

about 0.5 wt % to about 4 wt % of a carboxylate detergent; and about 0.5 wt % to about 8 wt % of a secondary antioxidant comprising a dithiocarbamate, a hindered phenol, or a molybdenum succinimide;

wherein at least 90% of the alkyl group of the alkylated diphenylamine have a carbon number between 10 and 15.

8. The method of claim 7, wherein the carboxylate detergent is an aromatic carboxylate or an aliphatic carboxylate.

9. The method of claim 7, wherein the carboxylate detergent is a salicylate, a naphthenate, or a stearate.

10. The method of claim 7, wherein the primary antioxidant is present in 0.4 wt % to 20 wt % of the lubricating oil composition.

11. The method of claim 7, wherein the carboxylate detergent is low overbased, medium overbased, high overbased or high high overbased.

12. The method of claim 7, wherein the lubricating oil composition further comprises:

an antioxidant, an ashless dispersant, an anti-wear agent, a detergent, a rust inhibitor, a dehazing agent, a demulsifying agent, a friction modifier, a metal deactivating agent, a pour point depressant, a viscosity modifier, an antifoaming agent, a co-solvent, a package compatibilizer, a corrosion-inhibitor, a dye, or an extreme pressure agent.

13. The lubricating oil composition of claim 1, wherein the hindered phenol is selected from 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol, and 4-dodecyl-2,6-di-tert-butylphenol.

14. The lubricating oil composition of claim 1, wherein the dithiocarbamate is an ashless dialkyl dithiocarbamate wherein the alkyl group has from 1 to 6 carbon atoms.

15. The lubricating oil composition of claim 1, wherein the molybdenum succinimide is derived from a polyisobutenyl succinic anhydride of 70 to 128 carbon atoms.

16. The method of claim 7, wherein the hindered phenol is selected from 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol, and 4-dodecyl-2,6-di-tert-butylphenol.

17. The method of claim 7, wherein the dithiocarbamate is an ashless dialkyl dithiocarbamate wherein the alkyl group has from 1 to 6 carbon atoms.

18. The method of claim 7, wherein the molybdenum succinimide is derived from a polyisobutenyl succinic anhydride of 70 to 128 carbon atoms.

* * * * *